US007287474B2

(12) United States Patent
Whitley

(10) Patent No.: US 7,287,474 B2
(45) **Date of Patent: *Oct. 30, 2007**

(54) CONSUMER PYROTECHNICS SUPPORT APPARATUS

(75) Inventor: James Whitley, Hillsboro, OR (US)

(73) Assignee: Spitdog Resources, LLC, Hillsboro, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/938,933

(22) Filed: Sep. 9, 2004

(65) Prior Publication Data

US 2005/0092622 A1 May 5, 2005

Related U.S. Application Data

(63) Continuation-in-part of application No. 10/666,037, filed on Sep. 22, 2003, now abandoned, and a continuation-in-part of application No. 10/853,186, filed on May 26, 2004, now abandoned.

(51) Int. Cl.

| | |
|---|---|
| ***F42B 4/00*** | (2006.01) |
| ***F42B 4/26*** | (2006.01) |
| ***F42B 5/24*** | (2006.01) |
| ***A45D 19/04*** | (2006.01) |
| ***A47J 47/16*** | (2006.01) |

(52) U.S. Cl. ..... 102/358; 102/335; 102/343; 102/501; 248/127; 248/523; 248/125.7

(58) Field of Classification Search ..... 89/1.8; 102/350, 335, 349, 351, 358, 343, 275.12; 248/127, 125.7, 125.9, 136, 523–527, 511, 248/519, 539, 160, 156, 174, 175, 176.1, 248/143, 104; 446/212; 211/69.1, 60.1; 16/2.1; 24/30.5 S; 294/31.2, 33, 148, 902, 294/166; 132/237

See application file for complete search history.

(56) References Cited

U.S. PATENT DOCUMENTS

| | | | | |
|---|---|---|---|---|
| 217,366 | A | 7/1879 | Grom | |
| 811,742 | A | 2/1906 | Petrie | |
| 878,233 | A * | 2/1908 | Paulson | 211/74 |
| 1,028,787 | A * | 6/1912 | Rossmeissl | 248/525 |
| 1,546,314 | A * | 7/1925 | James | 248/524 |
| 1,600,969 | A * | 9/1926 | Beers | 206/423 |
| 1,733,011 | A * | 10/1929 | Healy et al. | 248/524 |
| 2,005,467 | A | 6/1935 | Menge | 47/41.11 |
| 2,023,340 | A * | 12/1935 | Peskulich | 248/524 |
| 2,070,414 | A | 2/1937 | Snell | 65/61 |
| 2,269,589 | A | 1/1942 | Kaufman | 40/131 |

(Continued)

FOREIGN PATENT DOCUMENTS

DE 29920001 U1 3/2000

(Continued)

OTHER PUBLICATIONS

U.S. Appl. No. 11/102,480 (a CIP of the present application) filed Apr. 7, 2005; Copies of Office Actions dated: Aug. 22, 2007 and Apr. 10, 2007.

*Primary Examiner*—Teri Pham Luu
*Assistant Examiner*—Joshua Michener
(74) *Attorney, Agent, or Firm*—Stoel Rives LLP

(57) ABSTRACT

A reusable pyrotechnics support device for securely holding consumer ground-based fireworks (for example, fountains, mortars, multiple aerials, and the like) in a vertical and upright position, using a sufficiently wide base that is resistant to tipping over. In certain configurations, the apparatus is a molded plastic element formed in a generally round shape with an outer annular section and a series of resilient flexible cantilever tines extending radially inward toward a central aperture serving as a primary insertion point for the pyrotechnics.

41 Claims, 9 Drawing Sheets

U.S. PATENT DOCUMENTS

| | | | | | |
|---|---|---|---|---|---|
| 2,307,125 | A | * | 1/1943 | Goddard | 244/63 |
| 2,339,187 | A | * | 1/1944 | Pain | 248/314 |
| 2,494,995 | A | | 1/1950 | Gardner | 67/23 |
| 2,548,744 | A | * | 4/1951 | Simms | 220/89.2 |
| 2,634,070 | A | * | 4/1953 | Aguettaz | 248/524 |
| 2,733,699 | A | * | 2/1956 | Krinsky | 124/69 |
| 2,891,747 | A | * | 6/1959 | Gould | 47/40.5 |
| 2,908,461 | A | * | 10/1959 | Coffeen | 47/40.5 |
| 2,913,202 | A | * | 11/1959 | Meldrum | 47/40.5 |
| 3,058,708 | A | * | 10/1962 | Murray et al. | 248/102 |
| 3,086,674 | A | * | 4/1963 | Scheuerman | 220/229 |
| 3,096,960 | A | * | 7/1963 | Kinney | 248/113 |
| 3,170,213 | A | * | 2/1965 | Thomas, Jr. | 24/571 |
| 3,245,428 | A | * | 4/1966 | Boleslaw et al. | 137/493 |
| 3,280,744 | A | | 10/1966 | Brown | 102/37.4 |
| 3,297,289 | A | * | 1/1967 | La Raus | 248/152 |
| 3,365,761 | A | | 1/1968 | Kalvig | 24/257 |
| 3,381,825 | A | * | 5/1968 | Bessett | 211/74 |
| 3,463,536 | A | * | 8/1969 | Beyer et al. | 294/31.2 |
| 4,138,055 | A | | 2/1979 | Harrison | 232/1 C |
| 4,148,258 | A | | 4/1979 | Powers | 102/37.4 |
| 4,203,180 | A | | 5/1980 | Striplin | 24/17 B |
| 4,267,995 | A | | 5/1981 | McMillan | 248/74 R |
| 4,318,193 | A | * | 3/1982 | Bayer et al. | 4/222 |
| 4,544,351 | A | | 10/1985 | Marsicano | 431/288 |
| 4,590,705 | A | * | 5/1986 | Prince | 47/32 |
| 4,644,610 | A | | 2/1987 | Fish | 24/30.5 S |
| 4,697,312 | A | * | 10/1987 | Freyer | 24/30.5 S |
| 4,771,695 | A | | 9/1988 | Simpson | 102/343 |
| 4,917,015 | A | | 4/1990 | Lowery | 102/342 |
| D311,477 | S | * | 10/1990 | Fallgatter et al. | D7/619.1 |
| 4,976,411 | A | | 12/1990 | Gordon et al. | 248/524 |
| 4,989,820 | A | | 2/1991 | Sterling | 248/523 |
| 5,016,853 | A | | 5/1991 | Cox | 248/523 |
| 5,099,527 | A | * | 3/1992 | Roose | 4/255.11 |
| 5,114,113 | A | * | 5/1992 | Krinner | 248/525 |
| 5,163,665 | A | * | 11/1992 | Klearman | 269/280 |
| 5,236,022 | A | * | 8/1993 | Husted | 141/358 |
| 5,243,153 | A | | 9/1993 | Holwerda | 181/208 |
| D340,297 | S | | 10/1993 | Hanson | D26/9 |
| 5,297,767 | A | | 3/1994 | Miller et al. | 248/311.2 |
| 5,513,885 | A | * | 5/1996 | Joffe | 294/31.2 |
| 5,560,315 | A | | 10/1996 | Lampe | 119/51.5 |
| 5,613,681 | A | * | 3/1997 | Allen | 273/271 |
| 5,673,893 | A | * | 10/1997 | Klein | 248/525 |
| 5,711,419 | A | | 1/1998 | Beales et al. | 206/148 |
| 5,725,193 | A | * | 3/1998 | Adams | 248/523 |
| 5,797,579 | A | * | 8/1998 | Krinner | 248/523 |
| D399,166 | S | * | 10/1998 | Wright | D11/130.1 |
| D414,273 | S | | 9/1999 | Smith et al. | D24/227 |
| 6,035,456 | A | * | 3/2000 | Taylor | 4/255.11 |
| 6,073,890 | A | * | 6/2000 | Daoud | 248/56 |
| 6,086,029 | A | | 7/2000 | Oliver | 248/200.1 |
| 6,095,058 | A | | 8/2000 | Earnhart | 108/43 |
| D443,811 | S | * | 6/2001 | Tisbo | D8/356 |
| 6,286,429 | B1 | * | 9/2001 | Marietta et al. | 102/342 |
| 6,491,267 | B1 | * | 12/2002 | Feldman | 248/176.1 |
| D482,255 | S | | 11/2003 | Winig et al. | D8/71 |
| 6,681,519 | B2 | * | 1/2004 | Cone | 47/40.5 |
| D499,005 | S | * | 11/2004 | Winig et al. | D8/356 |
| 6,861,108 | B1 | * | 3/2005 | Potoroka, Sr. | 428/17 |
| 7,004,179 | B1 | * | 2/2006 | Lunde | 132/273 |
| 2003/0070572 | A1 | * | 4/2003 | Tang | 102/349 |
| 2003/0150158 | A1 | | 8/2003 | Wright | 47/41.12 |

FOREIGN PATENT DOCUMENTS

| | | | | |
|---|---|---|---|---|
| EP | 0756150 | A1 | | 1/1997 |
| FR | 2581531 | A1 | | 11/1986 |
| FR | 2593279 | A1 | | 7/1987 |
| FR | 2803910 | A1 | | 7/2001 |
| GB | 2203524 | | * | 3/1987 |
| GB | 2203524 | A | | 10/1998 |

* cited by examiner

CONSUMER PYROTECHNICS SUPPORT APPARATUS

RELATED APPLICATION DATA

This application is a continuation in part of application Ser. No. 10/853,186 filed May 26, 2004 now abandoned, which in turn is a continuation in part of application Ser. No. 10/666,037 filed Sep. 22, 2003 now abandoned, each of these applications hereby incorporated by a reference.

BACKGROUND

The field of the present invention relates to pyrotechnic devices and, more particularly, to an apparatus for supporting, in a stable manner, consumer-type ground-based pyrotechnics such as mortars, projectiles, multiple aerials, fountains, and other pyrotechnic devices.

Pyrotechnics, or fireworks as they are commonly called, were discovered or invented by the Chinese in the 2nd century B.C. and have been used ever since for everything from warding off evil spirits to fighting wars. In the United States, fireworks were used extensively on Jul. 4, 1777 as a way to mark the Declaration of Independence one year earlier. Ever since, Americans have used fireworks to celebrate not only their independence, but a variety of other noteworthy events such as elections, parades, parties, holidays, commemorations, and the like. In the year 2000 alone, Americans consumed 152 million pounds of fireworks, according to the U.S. International Trade Commission. Unfortunately, in that same year fireworks devices were involved in 10 deaths and an estimated 11,000 injuries requiring professional medical care, with children under 15 accounting for almost half of all fireworks-related injuries, according to the U.S. Consumer Products Safety Commission, 2000 Fireworks Annual Report.

One of the more dangerous events that can occur is when a firework that has been stationed on the ground is activated and accidentally tips over. For example, in a multiple aerial device which emits a series of colored fireballs, the device is designed to shoot the fireballs directly upward. If the firework is placed on uneven or soft ground, or somehow malfunctions, and the firework tips over, the firework may shoot the fireball sidewards toward spectators, potentially causing serious injury.

In order to stabilize ground-based fireworks, and help prevent this type of accident from happening, many consumer-type fireworks have been manufactured with a wide base or equipped with a plastic foundation glued to the bottom of a cardboard launching tube. Despite these configurations, U.S. injury statistics indicate these configurations have not proved adequate.

Homemade solutions for securing ground-based fireworks are feasible, but not very practical. Among other things, a homemade solution is inconvenient to build, inconsistent from one person to the next, may not be usable or accessible to all citizens, and has no mass production viability. Homemade solutions are, by their very nature, largely untested craft-produced objects that can be implemented only on a case-by-case basis and in limited situations.

The present inventor has recognized the need for a simple and robust method for more safely securing ground-based consumer fireworks.

SUMMARY

The present invention is directed to a reusable pyrotechnics support device which securely holds consumer ground-based fireworks (for example, fountains, mortars, multiple aerials, and the like) in a vertical and upright position, using a sufficiently wide base that is resistant to tipping over. In certain configurations, the apparatus is a molded plastic element formed in a generally round shape with an outer annular section and a series of resilient flexible cantilever tines extending radially inward toward a central aperture serving as a primary insertion point for the pyrotechnics.

DESCRIPTION OF THE PREFERRED EMBODIMENTS

Figure 1:
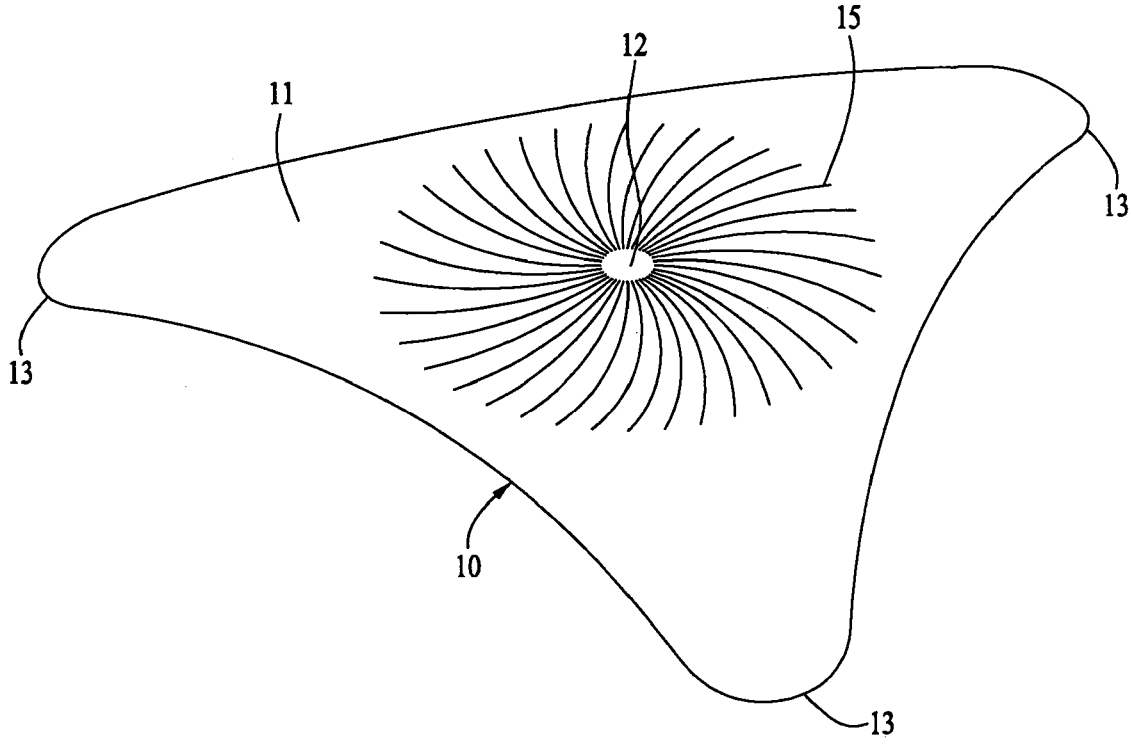
FIG. 1 is a perspective view of a fireworks holder according to a preferred embodiment.

The preferred embodiments will now be described with reference to the drawings. To facilitate description, any reference numeral representing an element in one figure will represent the same element in any other figure.

Figure 2:
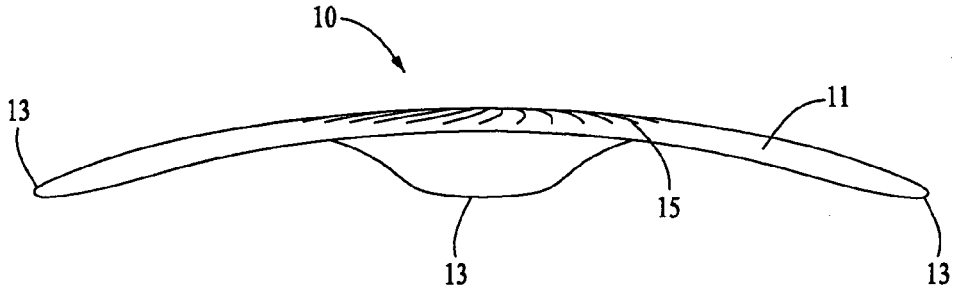
FIG. 2 is a side view of the fireworks holder of FIG. 1.

FIGS. 1-2 illustrate a fireworks support apparatus 10 according to a first preferred embodiment. The support device 10 includes a main platform body 11 forming a dais for a central positioning aperture 12. The positioning aperture 12 is an opening in the platform body 11 whose underside serves as the insertion point for the pyrotechnic device. Located at the apex of the platform 11 and round in this example, the positioning aperture 12 may be offset and/or square or may comprise a variety of other shapes or locations so as to accommodate the supported firework.

The outer shape of the platform 11 in this example is generally triangular, having three outwardly extending legs 13 providing additional stability to the platform 11.

Figure 3:
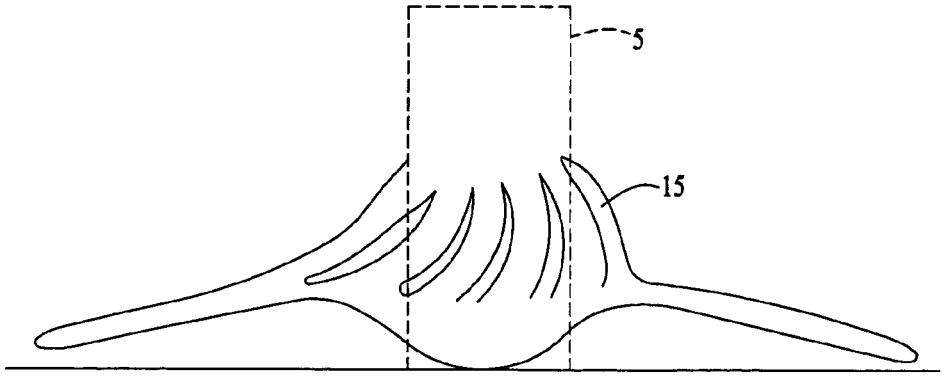
FIG. 3 is a side view of the fireworks holder of FIG. 1 holding a firework.

The platform 11 includes a plurality of generally uniform but independently-operating finger tines 15 disposed about the center portion of the platform 11 and extending radially inward toward the positioning aperture 12. In operation, the support device 10 is placed over the firework and pressed downwardly, the firework pressing upwardly through the aperture 12 and expanding the finger tines 15 upwardly and outwardly. Each of the finger tines 15 has a cantilever support formed in a swept or a spiral shape from the outer periphery toward the aperture 12. As the device 10 is continued to move downwardly over the firework, the finger tines 15 slide down the outer radial sides of the firework 5 as best shown in FIG. 3. Operating independently from each other, the flexible finger tines 15 may grip fireworks of various size and shape, but yet are resilient enough to return to their original resting position once the firework is removed. Flexibility and resiliency of the platform 11 depends upon the length of each of the finger tines 15, their design, and the material of construction. There may be many suitable configurations for the finger tines for supporting the desired firework sizes and shapes while also providing the desired tine flexibility and resiliency.

The triangular-shaped configuration of the device 10 of FIGS. 1-3 is achieved by the use of three convex-shaped support legs 13. The legs themselves may be sufficiently weighted and wider than the central platform section to which they are attached. Other configurations such as having four legs rather than three may be utilized. The width and weight of the legs may be modified, but are preferably selected to provide a stable structure, resistant to tipping over, as well as providing for the central cantilever tine section.

In operation, the firework support device 10 accepts a downward pressure of reasonable arm strength so as to receive the firework, which may be stationed vertically on the ground, through the underside of the tine platform 11 then pressed through the positioning aperture 12. As this force is applied through the bottom and out the top side of the firework support device 10, the firework being received juts up, out and passes through the positioning aperture 12 with the flexible platform 11 temporarily flexing upwardly and away from the firework. The tines 15 remain sufficiently resilient to retain a firm grip on the outside wall of the firework. Preferably, the finger tines 15 are formed in a general uniform pattern so as to completely surround the entire firework. The finger tines 15 operate independently from each other so as to accommodate different sizes and geometric shapes of fireworks.

To properly secure a firework, the support device is pushed all the way down over the firework so that the support legs 13 are horizontally aligned with the firework base, thus creating a multi-legged foundation as best shown in FIG. 3. In this manner, the support legs 13 and the firework 5 work together to create a stable foundation that is more resistant to tipping over than if the firework were set on the ground by itself.

Once the firework has been used, it may be removed from the firework support device 10 by pulling the firework in the opposite direction it was originally inserted. Alternately the firework may be pushed upward in the same direction through which it was originally inserted and pulled out past the bottom end. Once the firework has been removed, each of the finger tines 15 of the platform 11 return to their original resting position and ready to accommodate another firework in reuse.

The fireworks support devices may be formed from metal or other suitable nonflammable material, such as plastic, that is preferably resistant to heat and flame but having the sufficient flexibility, resiliency and weight characteristics to provide the desired operation.

Figure 4:
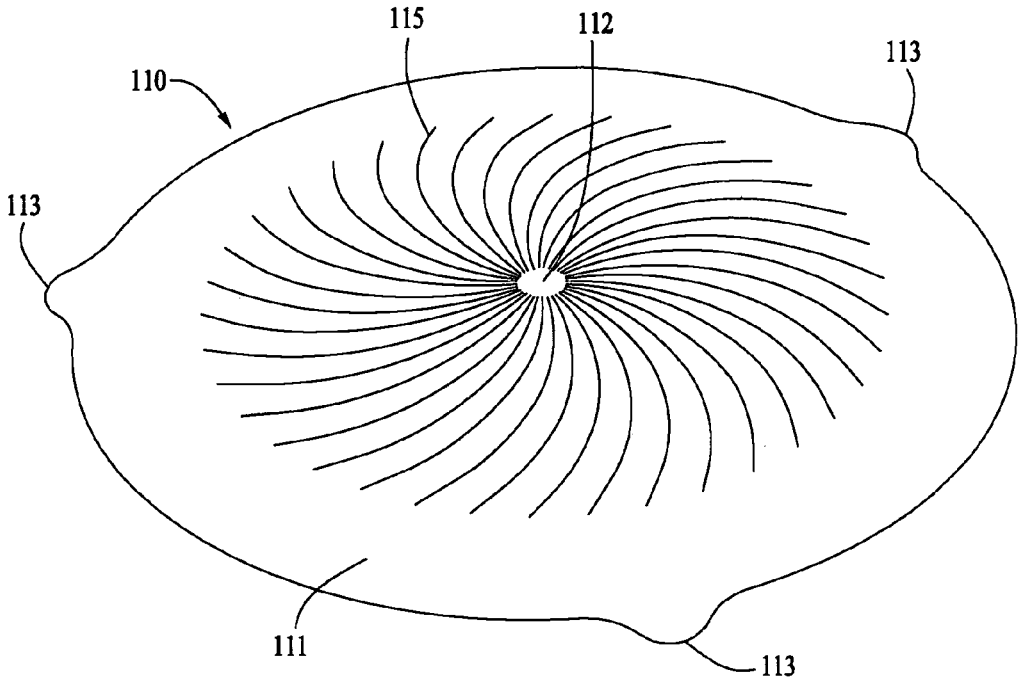
FIG. 4 is a top-down perspective view of a fireworks holder according to a first alternative embodiment.
Figure 5:
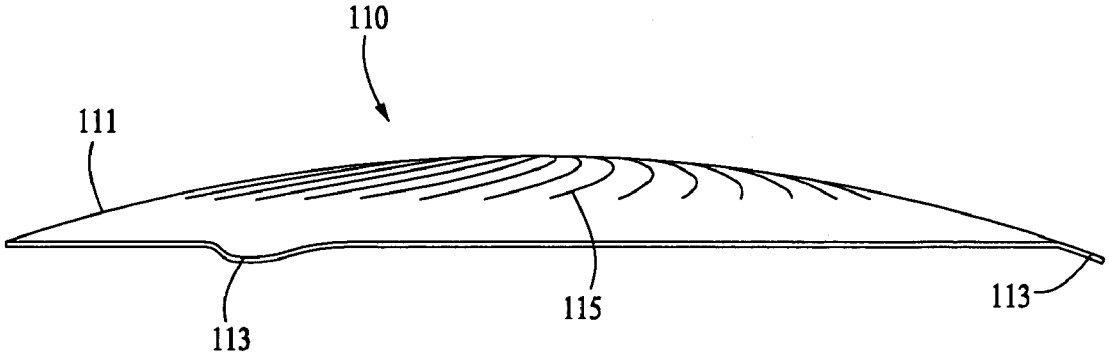
FIG. 5 is a side view of the fireworks holder of FIG. 4.
Figure 6:
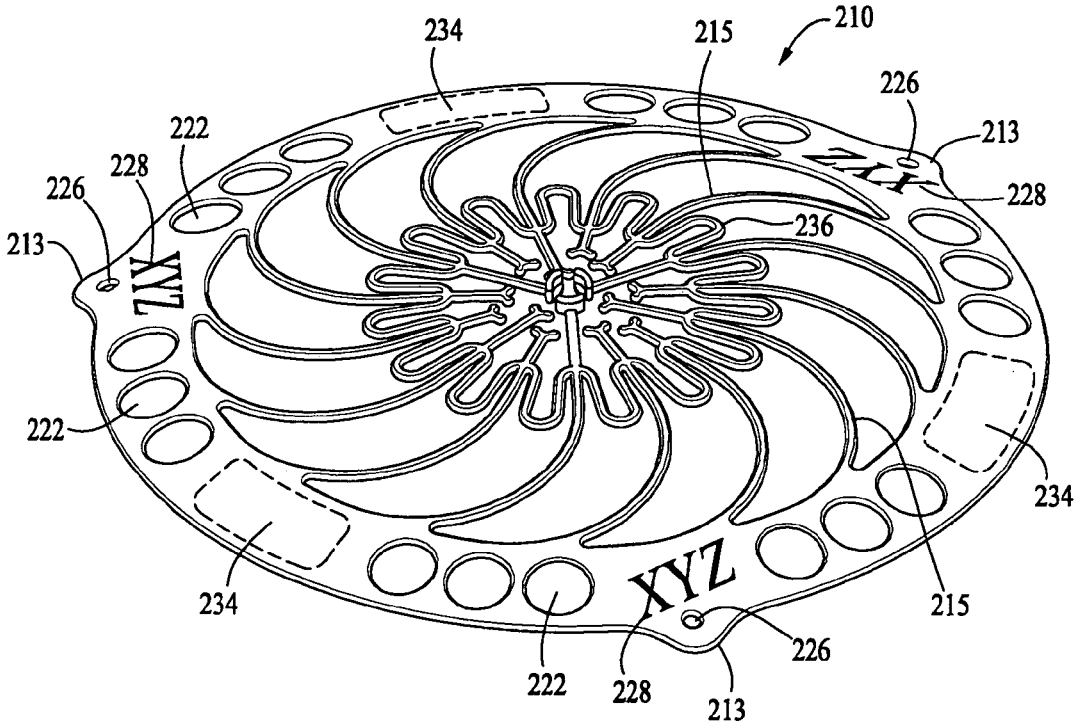
FIG. 6 is a top perspective view of a fireworks holder according to another alternative embodiment.
Figure 7:
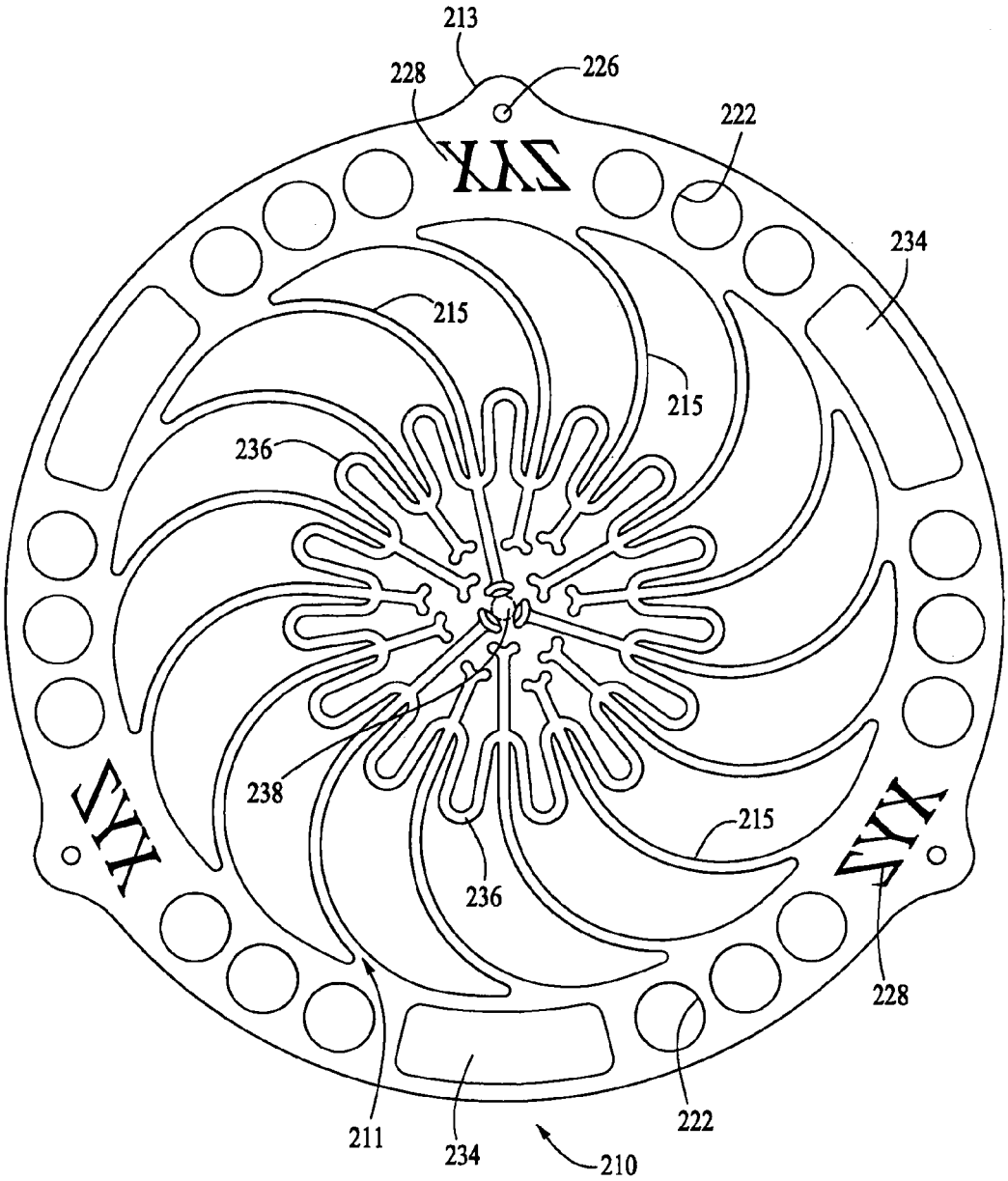
FIG. 7 is bottom plan view of the fireworks holder of FIG. 6.

Other configurations may be employed. FIGS. 4-6 shows a generally circular fireworks support device 110 having more of a round shape as compared to the triangular shape support device 10 of FIG. 1. The support device 110 nonetheless retains many of the same general features and the same functional aspects as the previous embodiment. Given the general diameter of the unit, support legs may be eliminated or as shown in the device 110, minimized or fairly small as the three support legs 113 evenly spaced about the outer perimeter of the device 110. The device 110 has a central tine platform 111 comprised of a plurality of cantilever finger tines 115 formed in a radially inward swept or spiral shape toward the central aperture 112.

The operation and function of the support device 110 is similar to that described in the previous embodiment of FIGS. 1-3. Each of these firework holder devices 10, 110 are formed in an upwardly-domed shape as best illustrated in the side views of FIGS. 2 and 5.

Another alternative fireworks support device 210 is illustrated in FIGS. 6-9. The device 210 is formed of plastic, metal or other suitable flexible and resilient material that is sufficiently flame and heat resistant. In a preferred construction, the device 210 is constructed from phosphorescent plastic, e.g. polycarbonate with a photoluminescent additive, or is made of some other material with a phosphorescent coating which serves to glow in the dark thus providing the opportunity for additional lighting during nighttime use.

The support device 210 of FIG. 6 is formed with a generally round, convex shaped support platform 211 with three uniformly spaced support legs 213 for providing added stability. The support platform 211 is in the shape of an outer annular band. While the support device 210 is shown in a generally round configuration, other geometric shapes and configurations may be employed. The support platform 211 provides a sufficiently wide base that is resistant to tipping over and provides support for the internal cantilever tines 215. In combination, the support platform 211 and the tines 215 form an upwardly curved or domed shape.

Adjacent to each of the three support legs in 213 are round anchoring holes 226. The anchoring holes 226 provide the ability to secure the device 210 to a support surface such as via nails, wire, or other suitable fasteners. The anchoring holes 226 also serve to marginally reduce the material volume needed to manufacture the support device 210.

Within the support platform 211 of the support device 210 are a series of material reduction apertures 222. These material reduction apertures 222 are merely holes in the support platform 211 that serve to reduce the material volume needed to manufacture the support device 210. These reduction apertures 222 are shown as round and symmetrical in the device 210, but they could be square, polygonal or any of a wide variety of size and shapes as well as positioned in any number of locations, patterns and quantities.

Located with the support platform 211 and adjacent to each of the three support legs 213 and anchoring holes 226 are artwork regions 228. Each artwork region 228 may serve to showcase a vendor's brand upon the fireworks support device 210. In the device 210, the artwork region is represented by a symmetrical hollow "XYZ" brand cutout actually formed during the mold process. Thus the artwork regions have the dual function of providing a brand indication of letters or company logo for the device as well as serving to reduce the material volume needed to manufacture the support device 210. The artwork regions 228 may be of different size, quantity and location about the support platform 211, alternately etched into the support platform 211, or alternately replaced by material reduction apertures.

Also shown in FIG. 6 are three consumer notice regions 234 symmetrically located along the support platform 211. These recessed consumer notice regions 234 may accommodate stickers or labels, such as usage instructions and warnings. These consumer notice regions 234 may be located anywhere along the support platform 211 or may be placed by artwork regions 228 or other material reduction apertures 222.

The central gripping function of the fireworks support device 210 is derived from a series of independent radial cantilever tines 215 which come together in a central location to create a central positioning aperture 238. The positioning aperture 238 is an opening in the fireworks support device 210 whose underside serves as the insertion point for the firework. Located at an apex of the dome-shaped configuration of the support device 210 and round in the illustrated example, the positioning aperture 38 may be square or a variety of other shapes to accommodate the supported fireworks.

The cantilever tines 215 extend radially inward from the support platform 211 toward the positioning aperture 38. The tines 215 are formed in a swept or spiral shape as they extend radially inward. The tines 215 are fairly slender, rod-like elements that are of round, polygonal, or other suitable cross sections so as to provide the requisite flexibility and resiliency yet achieve the desired supporting function. A controlling band 236 is used to join the radial series of cantilever tines 215 and together creating an intermediate interconnection which limits the horizontal movement of the tines 215 while allowing sufficient freedom to move semi-independent of one another in a vertical fashion. A controlling band 236 is shown in a generally sine wave form, especially in the example of FIG. 7, but the controlling band 236 may be straight, round, zigzag, polygonal or a variety of other shapes. The controlling band may comprise a sinusoidal-shaped structure interconnecting either certain of the tines or preferably all the tines. Similar to the tines, the band 236 is a rod-like element with a round, polygonal, or other suitable cross section.

Figure 8:
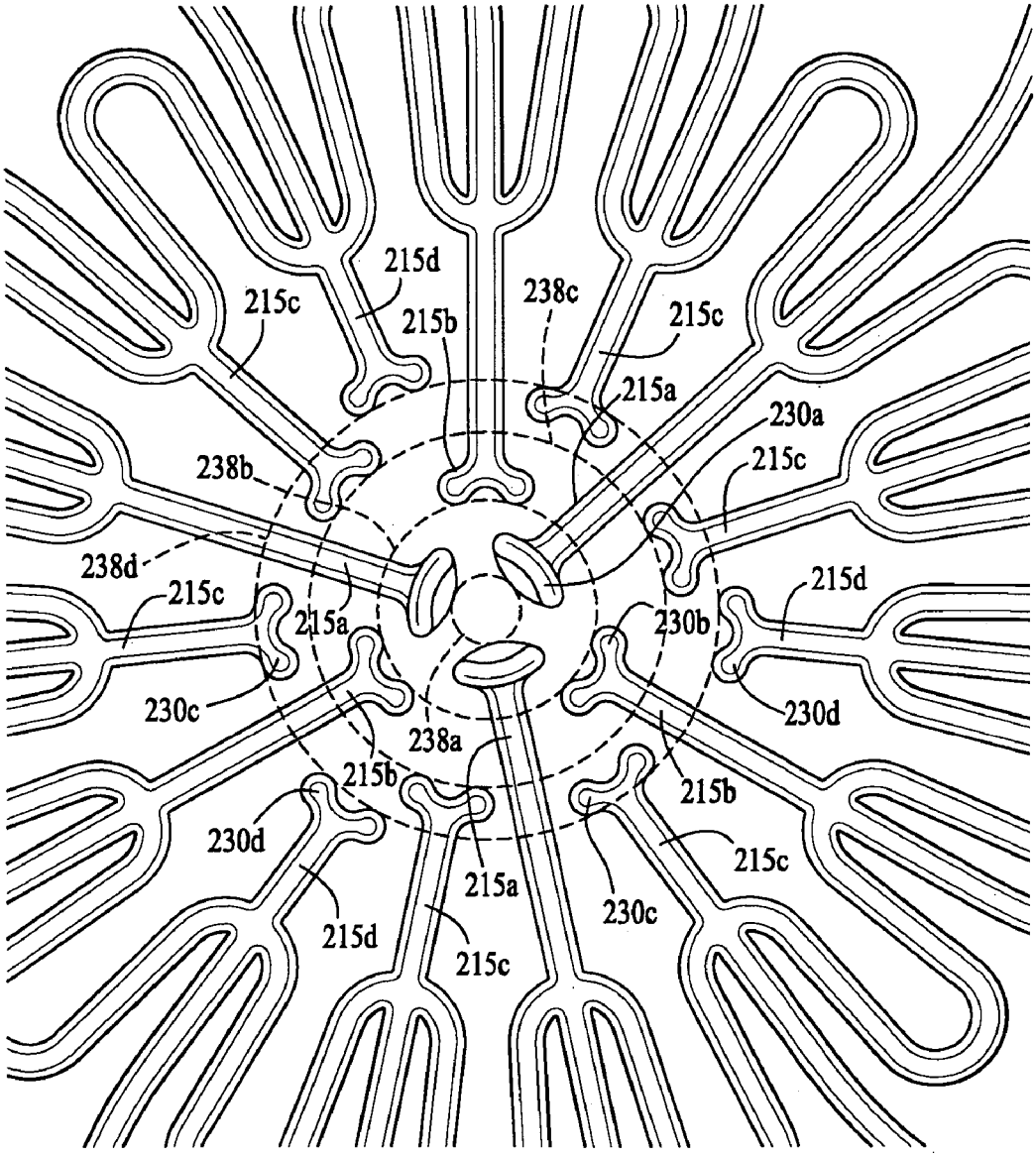
FIG. 8 is a detailed view of the central portion of the device of FIG. 7.
Figure 9:
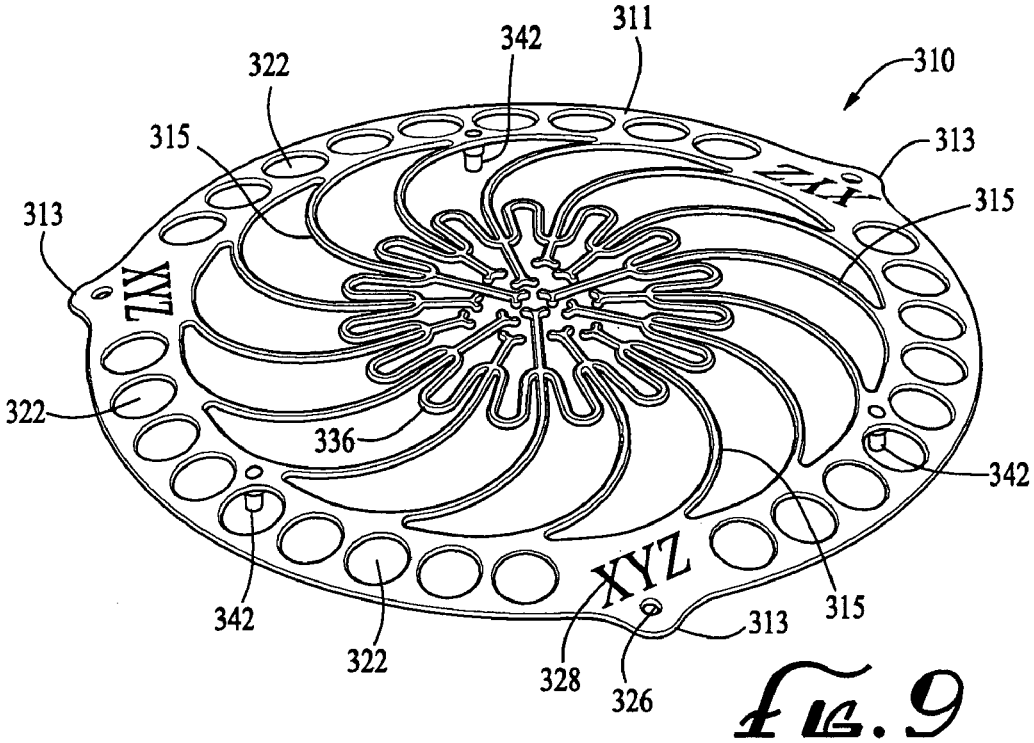
FIG. 9 is top perspective view of a fireworks holder showing another alternate embodiment.
Figure 10:
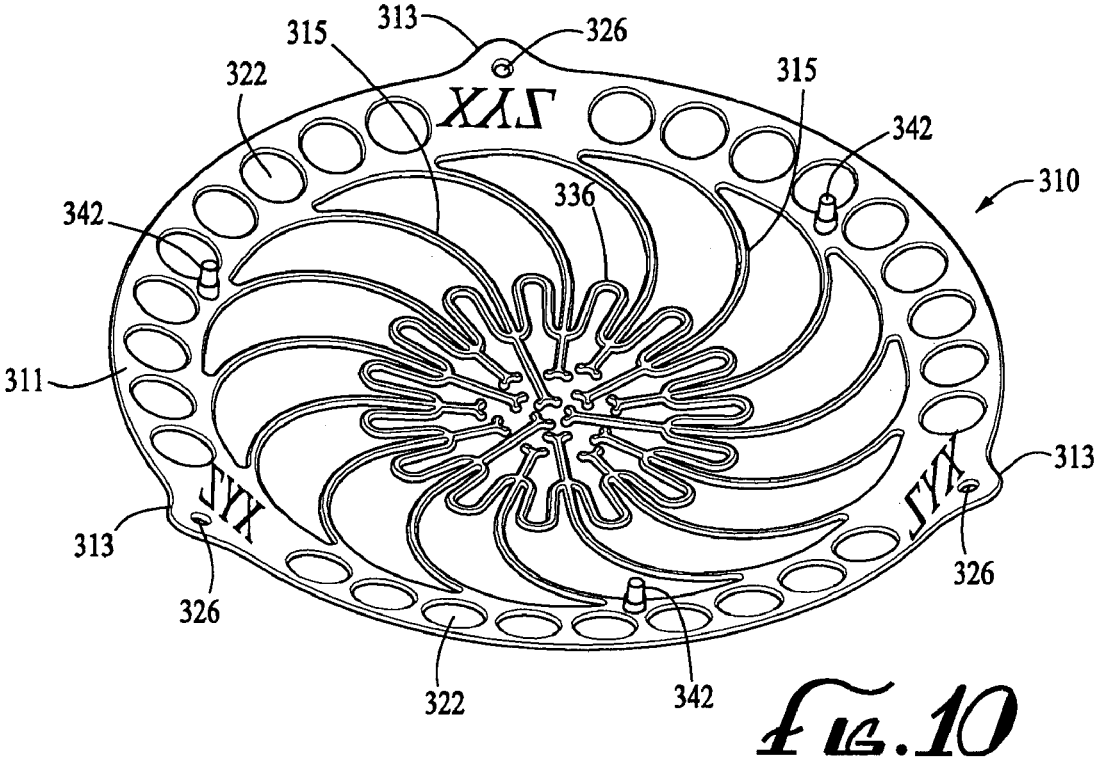
FIG. 10 is a bottom perspective view of the fireworks holder of FIG. 9.
Figure 11:
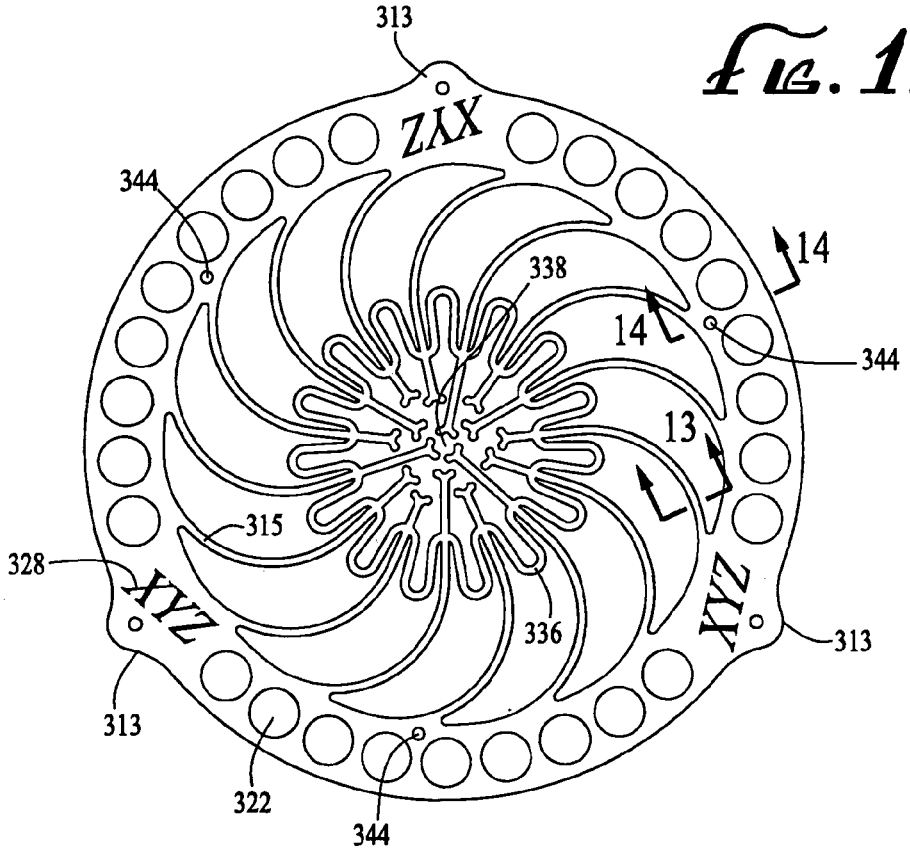
FIG. 11 is top plan view of the fireworks holder of FIG. 9.
Figure 12:
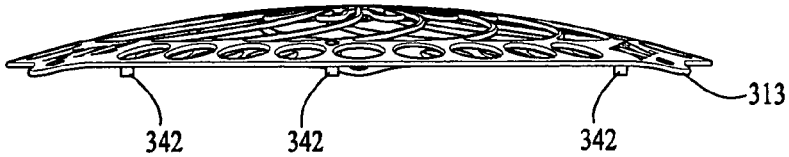
FIG. 12 is side elevation view of the fireworks holder of FIG. 9.

The cantilever tines 215 are of different lengths thus terminating at different radial distances toward the aperture 238. As best shown in FIG. 8, there are three central tines 215*a* extending to the furthest region forming a first aperture 238*a*), three secondary tines 215*b* (forming a second aperture 238*b*), six tertiary tines 215*c* (three of the tines 215*c* are actually at slightly different radial distances than the other three tines 215*c*, forming third aperture 238*c*) and three quaternary tines 215*d* extending the least radially inward (forming a fourth aperture 238*d*). Thus the device has five groups, each group having three spaced tines, the groups arranged at different radial distances from the aperture 238. The apertures 238*a-d* are preferably disposed in a coplanar arrangement.

The flexibility and resiliency of the cantilever tines 215 depend upon their length, design, configuration and material of construction. Each of the cantilever tines 215 shown in the device 210 is curved in a sweeping or spiral fashion which serves to lengthen the tine thereby lessening the pressure/stress upon them when in use. Other suitable configurations may be implemented.

Each of the cantilever tines 215 preferably includes a gripping flange 230 at its innermost termination point for contacting the outer wall of the firework being secured. The innermost cantilever tines 215*a* use a vertically cupped C-shaped gripping flange which juts out (i.e. having a longer vertical/axial extent) to firmly support the outer wall of small diameter fireworks. The remaining cantilever tines 215*b*, 215*c*, and 215*d* have horizontal gripping flanges of a generally Y-shape which are larger in diameter. For example, the inner cantilever tines 215*a* with the vertically cupped C-shaped gripping flange 230 support objects as small as ½ inch in diameter, while the overall device may support larger objects such as objects 8 inches in diameter.

In operation, the support device 210 accepts a downward reasonable arm strength pressure so as to receive the fireworks which may be stationed vertically on the ground, through the underside of the support platform 211 as its pressed through the positioning aperture 238. As force is applied to the top side of the fireworks support device 210, the firework being received juts up and out through the positioning aperture 238 with a radial series of cantilever tines 215 temporarily flexing up, out and away from the firework, yet remaining resilient enough to retain a firm grip on the outside wall of the pyrotechnic. The cantilever tines 215 are formed in a uniform pattern so as to completely surround and create tension pressure upon the firework on all sides. The radially formed cantilever tines 215 operate in conjunction with the controlling band 236 to allow semi-independent tine movement so as to accommodate a wide variety of sized and geometrically-shaped fireworks.

To properly secure a firework, the fireworks support device 210 is pushed all the way down over the pyrotechnic it is supporting until the support legs 213 are horizontally aligned with the firework base, thus creating a multi-legged support platform. In this manner, the support legs 213 and the pyrotechnic work together to create a stable support platform that is more resistant to tipping than if the firework were set on the ground by itself.

Once the firework has been used, it may be easily removed from the fireworks support device by pulling the firework and the firework support device 210 away from one another in a direction that is most convenient. Once the firework has been removed, cantilever tines 215 return to their resting position, once again ready to support another firework in reuse.

The terminations or radially inward ends of each of the tines may be formed with an end element 230 of suitable configuration. The end element 230 is the portion of the device 210 coming into contact with the lateral sides of the firework. The end element 230 may have a configuration designed to enhance gripping contact with the firework such as a grip or flange section. In one configuration the end element 230 is formed in a "Y" shape similar in shape to the end of a shuttle board stick having rounded edges throughout. In a preferred configuration the innermost extending tines 215*a* have a slightly differently shaped end element 230*a* in a "C" shape section that is axially (vertically) extended in a cupped fashion as shown in FIG. 8. This additional axial extension serves to provide additional contacting area for supporting smaller diameter fireworks which may be contacted primarily or only by the innermost tines 215*a*. The remaining tines 215*b*, 215*c*, and 215*d* have Y-shaped end elements 230*b*. Both the Y-shape and the C-shape termination ends are oriented with a concave portion disposed radially inward for providing added contact area onto the firework.

Other suitable shapes for the end elements 230 may be employed. For example the end element 230 may be merely a termination of the slender rod, such as a hemispherical shaped rod end. The end elements may be the same for all the tines or may be different in various combinations. Various end elements may be employed with any of the holder devices 10, 110, 210, 310 disclosed herein.

FIGS. 9-14 illustrate another preferred embodiment of a fireworks support device 310 similar to the device 210 of the previous embodiment. The support device 310 includes an outer annular tine platform 311 with fifteen radially inwardly extending tines 315. In combination, the support platform 311 and the tines 315 form an upwardly curved or domed shape. The tine platform 311 of the device 310 has a larger number of mass reduction openings 322 than the previous embodiment.

Figure 13:
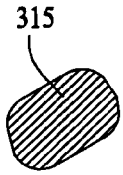
FIG. 13 is a cross-sectional view of a radial tine taken along line 13-13 of FIG. 11.
Figure 14:
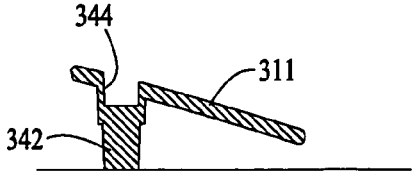
FIG. 14 is a cross-sectional view of the tine platform taken along line 14-14 of FIG. 11.

The radially inward extending tines 315 comprise slender rod-like members the cross section of which may be approximately oval in shape (as illustrated in FIG. 13), square, polygonal, round, or other suitable shape. The tines are formed in a spiral or inwardly swept curve extending from the tine platform 311 to the central aperture 338 and interconnected by the controlling band 336 to allow both for semi-independent tine movement but with the desired combination of flexibility and stiffness.

The outer annular tine platform 311 includes foot sections 313 each having a hole 326 useful for securing the device 310 to the ground or to a base.

The device 310 also includes a stacking mechanism whereby two or more of the devices 310 may be stacked together to enhance the vertical support and add additional stability to the support device. This stacking capability is provided by posts 342 arranged on the underside of the tine platform 311 and extending axially downward. On the opposite end of the post 342 is an indentation or hole 344 extending to the top surface of the tine platform 311. The inner diameter of the hole 344 is large enough to accommodate the end of the post 342 such that when a second support device 310 is placed on top of a first support device, the post 342 of the top device will nest into the hole 344 of the lower support device 310, preferably with an interlocking or snap-fit, securing the two devices together. The posts 342 of a bottom device extend downwardly to a position level with the ground The result is that two or more devices may be stacked together increasing the number of tines contacting/supporting the firework as well as staggering the tines at different heights.

The remaining features of the support device 310 are the same as those set forth in the previous embodiment and are not repeated for the sake of conciseness.

The holder devices are preferably formed in a plastic injection molding. Certain of these holder devices require quite complex molding process due to the relatively detailed elements. Molding of the fireworks holder may present production challenges. Molding of these types of parts may be accomplished by one skilled in the art of molding. Following is a discussion of some example molding steps that may be used, but the fireworks holder may be formed any suitable manufacturing process.

Molding cycle time is controlled by two main factors: (1) How fast the plastic can be shot into the mold; and (2) How fast the plastic can be cooled so that it will hold its shape after it is removed from the mold.

Most molds have a channel for molten plastic to come into the mold called a "spru" and other channels to guide molten plastic to the part cavity called runners. The spru is usually relatively "cold" because it is the same temperature as the rest of the mold. For polycarbonate the mold usually runs at about 200-230° F. while the nozzle will run at 600-700° F. The moment plastic starts going through the spru it starts cooling and thickening. If it gets too cool it will become solid and form what is called a cold slug or blockage in the spru. This blockage will keep the plastic from completely filling the part. This is a particular problem with thin parts that have long thin details like the fireworks holder. One method to eliminate/minimize this problem is using a mold with a heated spru and heated runners. This mold configuration may keep the plastic hot right up until it goes into the part. An added benefit to hot runners is that there is no waste of plastic. Minimizing plastic waste is very important to part price when the plastic is several dollars per pound.

Typical production tools are made from P-20 Steel because it is very hard and lasts a long time under the harsh continuous stresses and abrasions. One limitation to P-20 is that it does not dissipate heat very well. Most production tools have water cooling lines in them similar to a radiator in your car. Cold water is pumped through the mold to remove the heat from the molten plastic. With the slow heat transfer of P-20 the cycle times would have been prohibitively long.

Aluminum can dissipate heat about ten times as fast as P-20 but it is more subject to wear. One configuration is to employ aluminum inserts in a steel mold. This configuration may get the benefit of quick cool via the aluminum inserts and better wear characteristics via the robust nature of P-20 for the moving parts. In order to improve wear on the inserts, the inserts may be constructed with an anodize coating. Anodizing makes the surface of the aluminum very hard and enhances wear characteristic thereby improving tool life.

Another way to reduce cost is by running the same amount of parts on a smaller less expensive machine. Injection machines also known as presses are rated by tonnage. Tonnage is a measure of how many tons of force can be resisted by the mechanical parts in the press. Molding a part of polycarbonate generally requires about two tons per square inch of surface area on the part. To run a 4-cavity mold, allowing four parts per shot would normally require a 500 ton machine. One way of reducing tonnage is via mold stacking. By placing two 2-cavity tools together stacked in one 250 ton press, the tonnage may effectively be cut in half thus reducing operating cost by about 30 percent. The special mold required may be more expensive, but in the long run there may be significant savings in production.

In view of this disclosure, it may be obvious to those having skill in the art that many changes may be made to the details of the above-described embodiments without departing from the underlying principles of the invention. The scope of the present invention should, therefore, be determined only by the following claims.

The invention claimed is:

1. A fireworks support device in combination with a firework comprising:

an outer annulus;

a plurality of flexible tines connected to the outer annulus and extending radially inward and terminating to form an inner aperture, the flexible tines flexing radially outward and axially while inserting fireworks of various diameters, wherein the tines comprise flexible rod-shaped members, each of the tines terminating at a termination end comprised of a flange for contacting the firework, wherein the flanges on the tines are selected from the configuration consisting of: a Y-shaped structure; cupped C-shaped structure; or combinations thereof, with a concave portion of the shaped structure disposed radially inward for contacting the firework.

2. A fireworks support device in combination with a firework, comprising an outer annulus;

a plurality of flexible tines connected to the outer annulus and extending radially inward and terminating to form an inner aperture, the flexible tines flexing radially outward and axially while inserting fireworks of various diameters;

a controlling band disposed intermediately between the outer annulus and the inner aperture, the controlling band connected to a plurality of the tines, wherein the device is constructed of one-piece integrally-molded plastic.

3. A device according to claim 2 wherein the tines comprise slender rod-shaped members.

4. A device according to claim 3 wherein the tines have a cross section selected from the group consisting of circular, oval, rectangular.

5. A device according to claim 2 wherein the tines comprise slender rod-shaped members, each of the tines having a termination end comprised of a flange for contacting the firework.

6. A device according to claim 2 wherein the tines comprise slender rod-shaped members, one or more of the tines having a termination end comprised of a flange for contacting the firework.

7. A device according to claim 2 wherein the plastic is formulated to be sufficiently heat resistant so as to resist melting or igniting when contacted by stray sparks from a firework.

8. A device according to claim 2 wherein the tines are constructed and arranged to form an upwardly-domed configuration when at rest to accommodate insertion of a firework from an underside of the device upwardly through the inner aperture, the tines flexing upwardly and radially outwardly for engaging all lateral sides of the firework.

9. A device according to claim 2 wherein groups of the tines terminate at different distances from the inner aperture.

10. A device according to claim 2 wherein the controlling band is connected to all of the tines.

11. A device according to claim 2 wherein the device is removable from a firework and reusable.

12. A device according to claim 2 wherein the tines are constructed and arranged to form an upwardly-domed configuration.

13. A device according to claim 12 wherein the tines are sufficiently flexible to allow insertion of a public consumer firework of various diameters, gripping all lateral sides of the firework when inserted, the tines being sufficiently resilient to permit removal of the firework, and returning to an at-rest condition for accepting another firework.

14. A device according to claim 2 further comprising a plurality of holes, each of the plurality of holes being configured for accepting a stake to secure the device to the ground.

15. A fireworks support device in combination with a firework, comprising:

an outer annulus;

a first plurality of flexible tines connected to the outer annulus and extending radially inward and terminating to form a first inner aperture at a first inner location for accommodating insertion of a firework;

a second plurality of flexible tines connected to the outer annulus and extending radially inward and terminating to form a second inner aperture generally coplanar with the first inner aperture and at a second inner location radially inward of the first inner aperture for accommodating insertion of the firework, wherein the flexible tines flexing outward and axially while inserting fireworks of various diameters, wherein the tines comprise slender rod-shaped members, one or more of the tines of each of the first and second pluralities having a termination end comprised of a flange for contacting the firework, wherein the flanges of the tines terminating at the first inner location have differing structures than the flanges terminating at the second inner location.

16. A fireworks support device comprising an outer annulus;

a plurality of flexible tines connected to the outer annulus and extending radially inward and terminating to form an inner aperture, the flexible tines flexing radially outward and axially for accommodating insertion of a firework;

a controlling band disposed intermediately between the outer annulus and the inner aperture, the controlling band connected to a plurality of the tines, wherein the device is constructed of one-piece integrally-molded plastic and wherein the plastic comprises a glow in the dark material.

17. A device according to claim 16 wherein the glow in the dark material comprises a photoluminescent material.

18. A fireworks support device comprising an outer annulus;

a plurality of flexible tines connected to the outer annulus and extending radially inward and terminating to form an inner aperture, the flexible tines flexing radially outward and axially for accommodating insertion of a firework;

a controlling band disposed intermediately between the outer annulus and the inner aperture, the controlling band connected to a plurality of the tines, wherein the device is constructed of one-piece integrally-molded plastic and wherein the tines form a swept or spiral shape as extending radially inwardly from the outer annulus toward the inner aperture.

19. A fireworks support device, comprising an outer annulus;

a plurality of flexible tines connected to the outer annulus and extending radially inward and terminating to form an inner aperture, the flexible tines flexing radially outward and axially while inserting fireworks of various diameters;

a controlling band disposed intermediately between the outer annulus and the inner aperture, the controlling band connected to a plurality of the tines, wherein the controlling band comprises a sinusoidal-shaped structure interconnecting all the tines.

20. A fireworks support device comprising an outer annulus;

a plurality of flexible tines connected to the outer annulus and extending radially inward and terminating to form an inner aperture, the flexible tines flexing radially outward and axially for accommodating insertion of a firework;

a controlling band disposed intermediately between the outer annulus and the inner aperture, the controlling band connected to a plurality of the tines;

a plurality of legs spaced about the outer annulus and extending radially outward therefrom, wherein the device is constructed of one-piece integrally molded plastic.

21. A fireworks support device, comprising an outer annulus;

a plurality of flexible tines connected to the outer annulus and extending radially inward and terminating to form an inner aperture, the flexible tines flexing radially outward and axially for accommodating insertion of a firework;

a controlling band disposed intermediately between the outer annulus and the inner aperture, the controlling band connected to a plurality of the tines, wherein the outer annulus contains a plurality of material reduction apertures.

22. A fireworks support device in combination with a firework, comprising an outer annulus and a plurality of flexible tines connected to the outer annulus and extending radially inward, wherein the outer annulus and the flexible tines forming an upwardly-domed shaped when at-rest, the flexible tines flexing outward and axially while inserting fireworks of various diameters from an underside of the device, certain of the tines having different length than other of the tines, wherein the device is constructed of molded plastic, wherein the plastic comprises heat-resistant polycarbonate material.

23. A fireworks support device in combination with a firework, comprising:

an outer annulus;

a first set of flexible tines connected to the outer annulus and extending radially inward and terminating to form a first inner aperture;

a second set of flexible tines connected to the outer annulus and extending radially inward and terminating to form a second inner aperture radially inward of the first inner aperture and generally coplanar with the first inner aperture, the flexible tines flexing outward and axially while inserting fireworks of various diameters.

24. A method of supporting a consumer firework comprising the steps of inserting a firework upwardly through a fireworks holder device having an outer annulus and a plurality of radially-inwardly extending flexible tines having termination ends that terminate toward a central aperture of the device, the flexible tines being interconnected intermediately between the outer annulus and the central aperture;

causing the termination ends of the tines to engage lateral sides of the firework and causing the tines to flex upwardly and radially outwardly as the firework is inserted upwardly through the holder device;

placing the firework and holder device on the ground or other support surface such that the outer annulus of the holder device contacts the ground or other support surface for stabilizing the firework.

25. A method of supporting a consumer firework comprising the steps of inserting a firework upwardly through a first holder device having an outer annulus and a plurality of radially-inwardly extending tines having termination ends that terminate toward a central aperture of the first holder device, wherein the first holder device is constructed in a single piece molded plastic;

causing the termination ends of the tines to engage lateral sides of the firework as the firework is inserted upwardly through the first holder device;

placing the firework and first holder device on the ground or other support surface such that the outer annulus of the first holder device contacts the ground or other support surface for stabilizing the firework;

providing the first holder device with interconnections;

placing a second holder device onto the first holder device and connecting the second holder device to the first holder device via the interconnections.

26. A method according to claim 24 wherein the tines comprise slender members in shape of a rod.

27. A method according to claim 26 wherein the tines have a cross section selected from the group consisting of circular, oval, rectangular.

28. A method according to claim 24 wherein the holder device is constructed of integrally-molded plastic.

29. A method according to claim 28 wherein the plastic is formulated to be sufficiently heat resistant so as to resist melting or igniting when contacted by stray sparks from the firework.

30. A method according to claim 24 further comprising forming the tines in an upwardly-domed configuration when at rest to accommodate insertion of a firework from an underside of the holder device upwardly through the inner aperture, the tines flexing upwardly and radially outwardly for engaging all lateral sides of the item.

31. A method according to claim 24 wherein the holder device is made from molded plastic and wherein the plastic comprises a glow in the dark material.

32. A method according to claim 31 wherein the glow in the dark material comprises a photoluminescent material.

33. A method according to claim 24 further comprising forming the tines form in a swept or spiral shape as extending radially inwardly from the outer annulus toward the inner aperture.

34. A method according to claim 24 further comprising terminating groups of the tines at different distances from the inner aperture.

35. A method according to claim 24 wherein the connector element comprises a controlling band disposed between the outer annulus and the inner aperture, the controlling band interconnecting a plurality of the tines.

36. A method according to claim 35 wherein the controlling band comprises a sinusoidal-shaped structure interconnecting all the tines.

37. A method according to claim 24 further comprising removing the holder device from the firework and reusing the holder device.

38. A method according to claim 24 further comprising forming the holder device of molded plastic, wherein the tines are constructed and arranged to form an upwardly-domed configuration.

39. A method according to claim 38 wherein the tines are sufficiently flexible to allow insertion of items of various diameters, gripping all lateral sides of a firework when the holder device is placed over the firework inserted, the tines being sufficiently resilient to permit removal of the firework, and returning to an at-rest condition for accepting another firework.

40. A method according to claim 24 wherein the steps of inserting a firework upwardly through a fireworks holder device and placing the firework and holder device on the ground or other support surface are executed in the order of (1) placing the firework on the ground or other support surface;

(2) inserting the firework upwardly through the fireworks holder device by passing the fireworks holder device downwardly over the firework thereby causing the termination ends of the tines to engage the lateral sides of the firework;

(3) continue passing the fireworks holder device downwardly over the firework until the outer annulus contacts the ground or other support surface.

41. A method according to claim 24 further comprising providing the outer annulus with a plurality of anchor holes spaced about the outer annulus;

securing the fireworks holder device to the ground by inserting an anchoring element through the holes and into the ground.

* * * * *